US005878899A

United States Patent [19]

Manganiello et al.

[11] Patent Number: 5,878,899

[45] Date of Patent: Mar. 9, 1999

[54] LINER HOLDER ASSEMBLY

[75] Inventors: Francis X. Manganiello, Pompton Plains, N.J.; Aiden John Petrie, Providence, R.I.

[73] Assignee: Playtex Products, Inc., Westport, Conn.

[21] Appl. No.: 810,444

[22] Filed: Mar. 4, 1997

[51] Int. Cl.[6] ..... A61J 9/00; A61J 9/06; A61J 9/08

[52] U.S. Cl. ..... 215/11.6; 215/11.1; 215/11.3; 220/578

[58] Field of Search ..... 215/11.1, 11.3, 215/11.6, 11.5; 220/518

[56] References Cited

U.S. PATENT DOCUMENTS

| | | | |
|---|---|---|---|
| 720,902 | 2/1903 | DuBrau . | |
| 2,364,753 | 12/1944 | Richter | 215/12.1 |
| 3,093,256 | 6/1963 | Woodbury, Jr. | 215/11.1 |
| 3,232,467 | 2/1966 | Barton | 215/11.3 |
| 3,561,644 | 2/1971 | Works . | |
| 3,955,698 | 5/1976 | Hammer | 215/11.3 |
| 3,998,348 | 12/1976 | Sammaritano | 215/11.3 |
| 4,010,861 | 3/1977 | Welten | 215/11.5 |
| 4,176,754 | 12/1979 | Miller | 215/11.3 |
| 4,759,453 | 7/1988 | Paetzold | 215/11.6 X |
| 4,796,767 | 1/1989 | McKeown | 215/11.1 |
| 4,815,615 | 3/1989 | Phlaphongphanich | 215/11.1 |
| 5,301,825 | 4/1994 | DiScala et al. | 215/11.1 |
| 5,524,783 | 6/1996 | Popoff | 215/386 |
| 5,536,016 | 7/1996 | Wiedemann | 215/11.3 |

FOREIGN PATENT DOCUMENTS

| | | | |
|---|---|---|---|
| 0 689 825 A1 | 1/1996 | European Pat. Off. . | |
| 79231 | 4/1935 | France | 220/578 |
| 2290718 | 1/1996 | United Kingdom . | |

*Primary Examiner*—Sue A. Weaver
*Attorney, Agent, or Firm*—Ohlandt, Greeley, Ruggiero & Perle, L.L.P.

[57] ABSTRACT

A holder assembly, for use with disposable baby feeding liners, includes a holder having a longitudinal slot and a member. The member has a disk and a finger-operated attachment joined to the disk at a single location. The attachment engages the longitudinal slot to mount the disk slidably within the holder. The attachment is readily adapted to assembly and disassembly. The holder, preferably, has a dual set of markings for determining the volume of liquid entering into the liner and the volume of liquid remaining in the liner as the baby is feeding.

43 Claims, 7 Drawing Sheets

LINER HOLDER ASSEMBLY

The present invention relates to a holder assembly for dispensing baby formula and the like. More particularly, this invention relates to a holder assembly that includes a holder for use with a disposable liner or sac, and a sliding member removably secured to the holder for expelling air from the liner. The sliding member can align with a series of markings on the holder in order to determine the amount of liquid remaining in the liner. The sliding member is constructed so as to be readily secured and removed from the holder thereby facilitating cleaning of the holder. Moreover, the holder assembly can be operated with one hand. In an alternative embodiment, the holder assembly may be constructed such that a nipple ring and nipple can be snap assembled onto or removed from the holder, preferably with one hand.

BACKGROUND OF THE INVENTION

Reusable baby bottles or hard bottles, such as made of glass or plastic, have been commonly used to feed babies formula, water, and other liquids. After liquid is placed in the bottle, a nipple is attached to the bottle and the assembly is ready for use. A hard bottle sometimes is cleaned and sterilized between each use, requiring substantial time and effort.

An alternative to a hard bottle is the disposable liner or sac (also referred to as a "disposable bottle") that is used in conjunction with a holder which supports the liner. The liner, which is used only once, is pre-sterilized, and is inserted into the holder. The liner is then filled with liquid, and a nipple is attached to the holder. This alternative is economical and sanitary, and greatly minimizes the time and effort required to prepare for feeding a baby.

One limitation inherent in hard bottles is the tendency of babies to ingest substantial amounts of air when ingesting the liquid. This air can cause uncomfortable distention and gas in the baby's stomach, and may lead to vomiting and other problems. Disposable liners collapse as liquid is drawn out, thus minimizing the amount of air the baby ingests. However, under some circumstances a small amount of air can be drawn in to the liner through the hole of the nipple.

Attempts have been made to address this problem. U.S. Pat. No. 3,998,348 to Sammaritano provides a roller assembly attached to the lower, closed end of the liner to take up the liner as it empties. U.S. Pat. No. 4,796,767 provides a pushrod stored on the outside of the holder. When in use, the pushrod is inserted through the open bottom of the holder to press air out of the liner through the attached nipple feeding hole. U.S. Pat. No. 4,176,754 to Miller provides a donut-shaped pneumatic roller used to press air out of the liner as discussed above.

Some patents provide a plunger-type insert having the general shape of the inside of the holder. The plunger can be pushed up within the holder to press air out of the liner. Certain devices use a plunger having a stem extending from the open bottom of the holder. Other devices require the user to reach inside the open bottom of the holder to operate the plunger.

Other patents provide a refinement on this construction employing a plunger-type insert that is operable by means located on the sides of the holder. U.S. Pat. No. 5,356,016 to Wiedemann provides a flat, circular plunger member having a pair of tab handles on its diameter that extend through a pair of longitudinal slots in the holder.

U.S. Pat. No. 3,955,698 to Hammer is a device somewhat similar to that shown in the Wiedemann patent. However, the Hammer device has a pair of tab handles that engage with ratcheted indentations on the interior surface of the holder. U.S. Pat. No. 5,301,825 to Di Scala et al. provides a related device in which the tab handles are connected in a ring extending around the holder.

The early devices appear to be unwieldy, unstable or awkward. The three latter devices have several limitations. First, each requires a complex disassembly of the tab or ring handles to clean the holder assembly. This is inconvenient and time-consuming for the user. Also, the devices with small tab handles are removable, and can pose a danger to the baby as small parts. Second, each device requires two hands to operate properly. The tab handle devices require the user to hold the holder in one hand, and apply pressure, preferably with the other hand, to the opposing tab handles simultaneously. The ring device requires the user to grasp the holder in one hand, and the ring, preferably with the other hand and at opposing points, to slide it. If used with one hand, slight movements of the ring might be possible, but any greater pressure may force the ring's edge into the holder surface and arrest further movement. Third, each device is bulkier than the present holder thereby making these known devices less attractive and, presumably, more expensive to make.

SUMMARY OF THE INVENTION

Against the foregoing background, it is a primary object of the present invention to provide a holder assembly that provides for efficient expulsion of air from a disposable liner or a preformed sac.

It is another object of the present invention to provide such a holder assembly that allows air removal from the liner, and can be held and operated effectively and easily with one hand by the user.

It is a further object of the present invention to provide such a holder assembly that is easy to clean.

It is a still further object of the present invention to provide such a holder assembly that has a dual marking system which allows pre-measuring of the liquid filled in the liner and permits accurate determination of the amount of liquid remaining in the liner as the baby is ingesting.

To the accomplishment of the foregoing objects and advantages, the present invention, in brief summary, comprises a holder having a single axial or lengthwise slot. A relatively circular disk having an outer diameter roughly the same size as the inner diameter of the holder is positioned within the holder and at the same time has ample clearance to allow vertical movement within the holder. In a preferred embodiment, the disk is mounted to an assembly that engages the lengthwise slot and extends outward from the slot for operation by the user. The assembly allows the disk to be axially moved within the slot solely by the pressure from a thumb (or other single finger). Thus, only one hand is needed to operate the holder.

The lengthwise slot has a circumferential width that provides access for the disk so that the disk can be readily assembled in the holder, and likewise readily disassembled from the holder, through the slot, and the assembly can readily engage and disengage the edges of the slot. In an alternative embodiment, the slot may be of a similar circumference, but broadens near the base of the holder to allow the assembly to be disengaged from the slot when dropped to its lowest position thereby allowing the disk and assembly to be removed from the holder.

DESCRIPTION OF THE PREFERRED EMBODIMENTS

Figure 1:
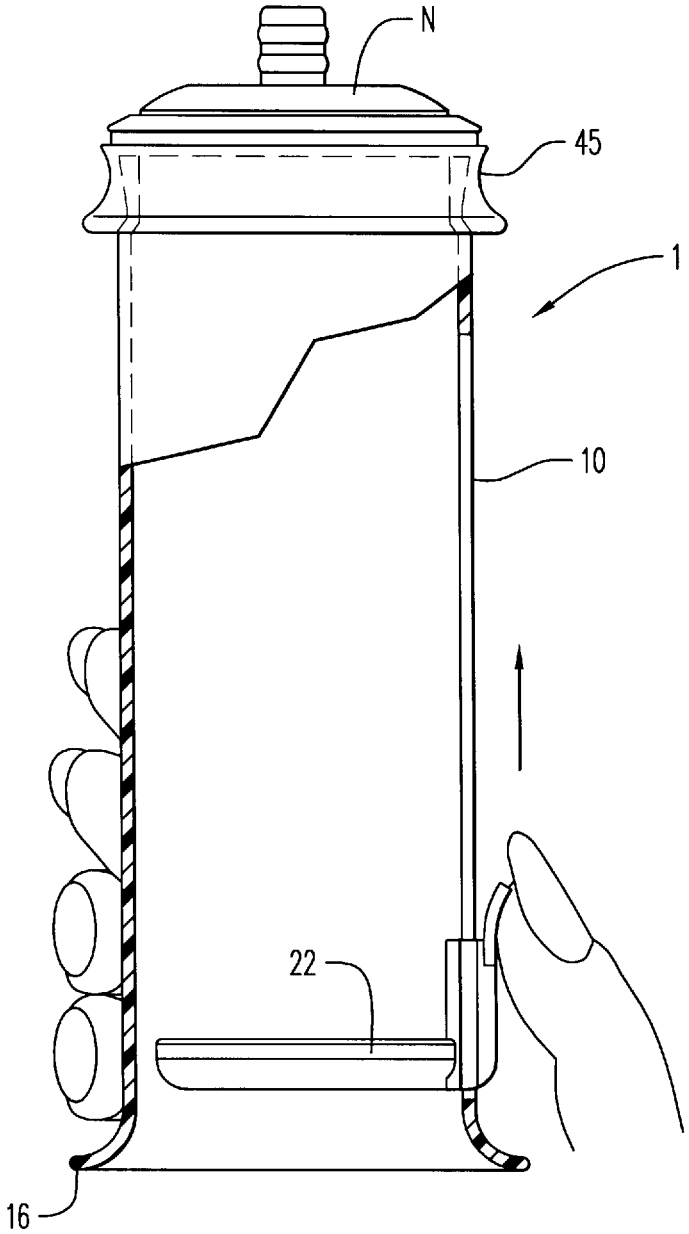
FIG. 1 is a plan view of a holder assembly of the present invention, with a nipple, retaining ring and liner.

Referring to the drawings and, in particular, FIG. 1, there is shown a holder assembly according to the present invention generally represented by reference numeral 1. The holder assembly 1 includes a hollow body or holder 10 and a plate or plunger member 22 adapted to be secured and movable therein. The holder assembly may include for use a nipple N and a nipple retaining ring 45.

Figure 2:
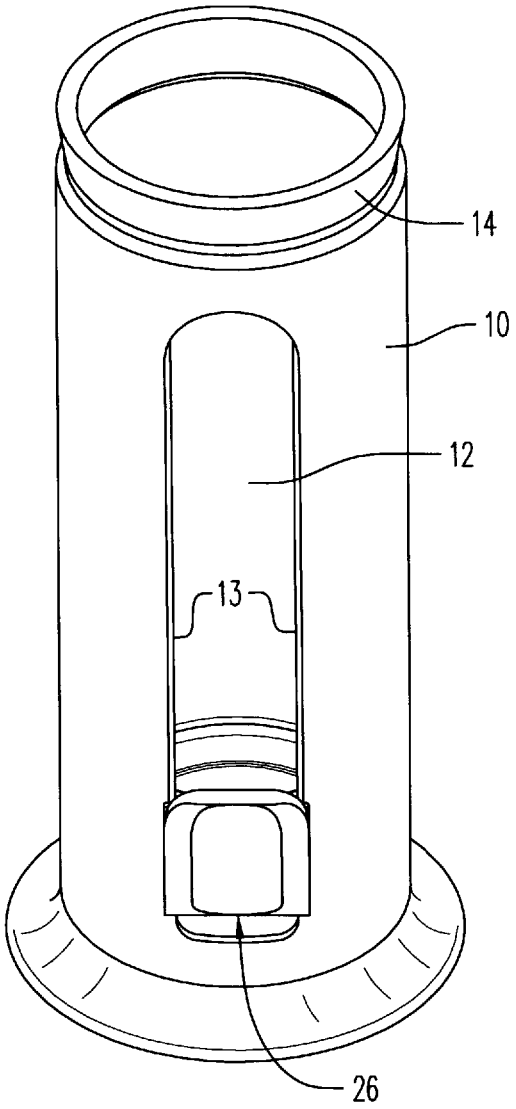
FIG. 2 is a first side view of the holder assembly of FIG. 1.

As shown clearly in FIG. 2, the holder 10 is preferably a hollow cylindrical tube, opened at both ends, having an outer diameter about 2.40 inches and an inner diameter about 2.15 inches. The holder 10 has a longitudinal or axial slot 12. The axial slot 12 preferably extends along most but not all of the length (as measured from top end to bottom end) of holder 10. The slot 12 has a uniform width or circumferential extant. The width of slot 12 is about 0.76 inches. The slot 12 has a pair of side edges 13. Each edge 13 is about 0.10 inches. Accordingly, the slot 12 and edges 13 have a width about 0.96 inches. The width of slot 12 is such that it permits the ready insertion and removal of member 22 shown in FIG. 1. The edge 13 permits for the easy securing of member 22 in slot 12 as discussed below.

Figure 3:
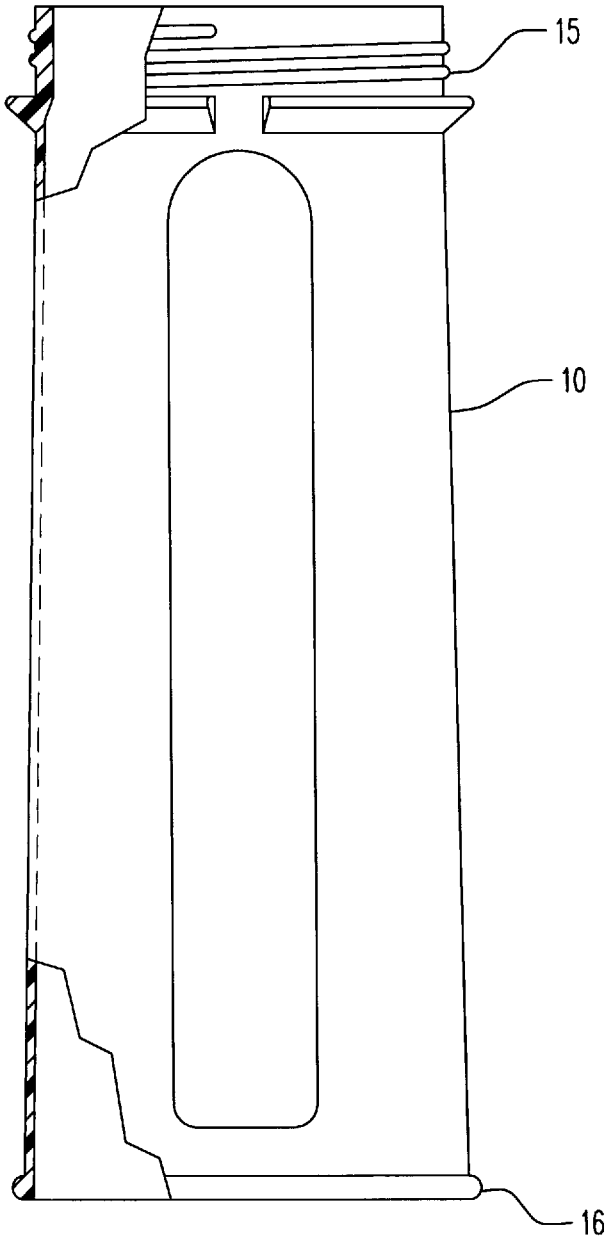
FIG. 3 is a partial first side view of a preferred holder of the holder assembly of the present invention.

As shown in the preferred embodiment of FIG. 3, the holder 10 has an open top at which a rim 14 is formed to accept the retaining ring 45 shown in FIG. 1. In the preferred FIG. 3 embodiment, the rim 14 has a threaded surface 15 that mates with the interior threads of a retaining ring 45 shown in FIG. 1.

In an alternative embodiment shown in FIG. 2, the rim 14 is a smooth surface, and is preferably biased inward from the top to the bottom in order to receive the retaining ring 45, shown in FIG. 1, having a non-threaded interior surface. The bias is approximately ten degrees to the vertical axis with a tolerance of plus or minus one-half degree.

In a preferred embodiment shown in FIG. 3, the holder 10 has a bottom edge 16 basically in the form of a bead. The beaded edge 16 is about 0.12 inches high. In an alternative embodiment shown in FIGS. 1 and 2, the holder 10 may include an enlarged solid bottom edge 16 to provide strength and rigidity to the structure. The edge 16 is preferably flared outward to provide stability to the holder 10 when it is placed in an upright position. The smooth surface rim 14 and enlarged edge 16 of the alternative embodiment of FIG. 2 is so that the retaining ring 45 can be snapped onto the holder, preferably by one hand of a user. Basically, the enlarged edge 16 supports the holder 10 during the snap-on application of the retaining ring 45.

In either embodiment, the holder 10 is preferably a cylindrical tube. The holder 10 can be any material that will not warp, and will hold the liner in position therein. The holder 10 is preferably formed of a rigid molded material, such as a rigid thermoplastic. Most preferably, the holder 10 is made of polypropylene. However, the holder 10 can, preferably, be made of polycarbonate or other rigid thermoplastic.

Figure 4:
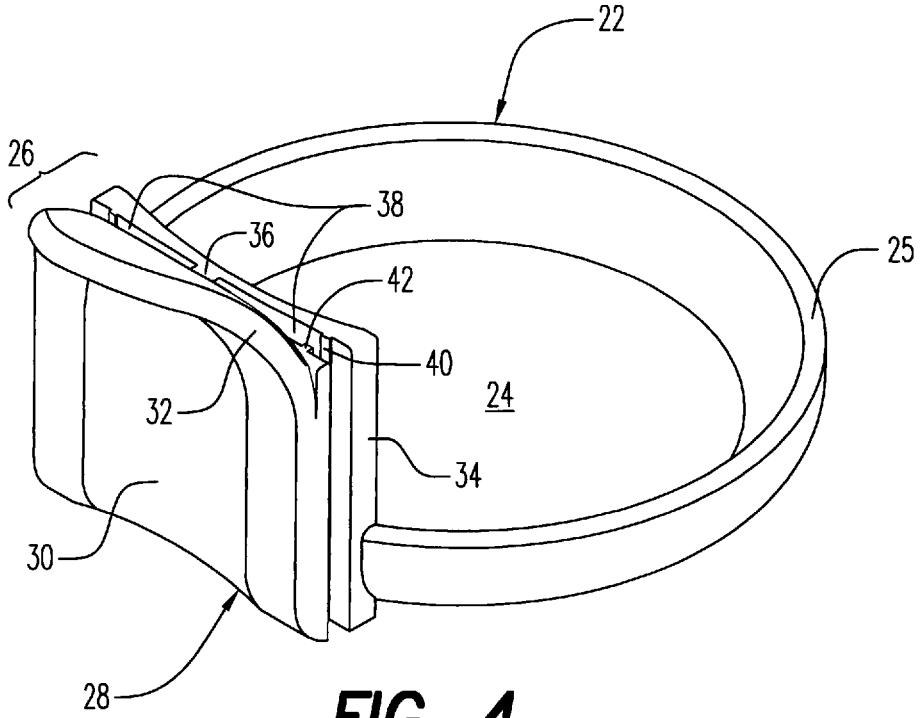
FIG. 4 is a perspective view of a preferred plunger member of the holder assembly of the present invention.

Referring to FIG. 4, the member 22 is, preferably, a single integral piece that includes a disk 24 and a tangentially attached unit 26. The disk 24 is preferably slim and circular, and includes a lip 25 about its circumference that forms a cup-shaped surface on the disk. The outer diameter of disk 24 and lip 25 is sized slightly less than the inner diameter of the holder 10 so as to permit the disk to move up and down within the holder. The cup-shaped configuration of the disk 24 is adapted to hold the bottom of a liner therein and helps prevent the liner from falling between the disk 24 and the inner wall surface of holder 10 as the member 22 including disk slides upward in the holder.

The unit 26 preferably has a plate 34 that is formed integrally with the disk 24 and extends upward and beyond the lip 25 of the disk 24, a pad 28 basically of the same overall shape of the plate, and an elongated bridge or rib 36 that connects the plate and the pad together, preferably at their center portions. On either side of rib 36 between plate 34 and pad 28, there is formed a channel 38. Each channel 38 is designed to accept and engage one side edge 13 of slot 12.

In one embodiment, the pad 28 is preferably arched in shape to approximate the contours of the user's thumb and, preferably, has an upper edge 32 that flares outward at the pad's arched center to form a thumb-accepting flared surface 30. The pad 28 will typically be wider than slot 12.

When member 22 is to be moved axially upward, the user's thumb or other finger will engage and press up on the flared surface 30 or the underside of the pad 28. When member 22 is to be moved axially downward, the thumb will rest on and press down on the top side of the same flared surface 30. Within channels 38, grooves 40 and opposing ridges 42 are formed that align with and abut the pair of side edges 13 of slot 12 to firmly and frictionally interlock unit 26 and holder 10. Accordingly, the unit 26, when at rest, holds its vertical position due to the frictional engagement of the edges 13 of slot 12 and the surfaces of channels 38. This frictional force is sufficient to keep unit 26 from sliding in slot 12 absent any pressure from the user. The force applied by the user to pad 28 to overcome this frictional engagement, is, however, small enough to allow easy and smooth one-handed operation.

Figure 5:
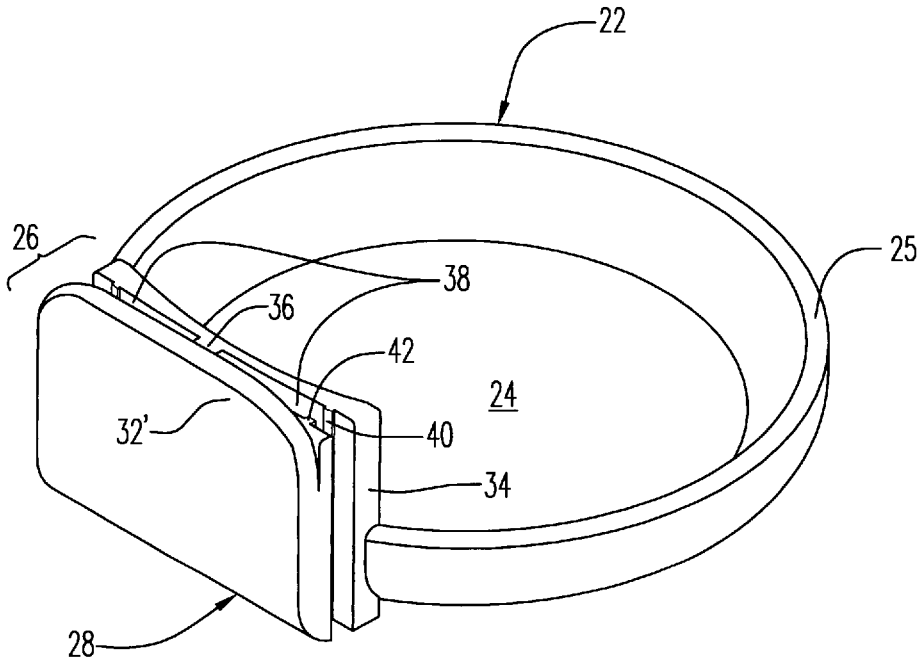
FIG. 5 is a perspective view of an alternative plunger member of the holder assembly of the present invention.

In an alternative embodiment shown in FIG. 5, unit 26 preferably has a first plate 34 formed integrally with disk 24 and extending upward and beyond the lip 25 of the disk, a second plate 28 basically of the same overall shape of the first plate, an upper edge 32', and an elongated bridge or rib 36 that connects the plates 34 together, preferably at their center portions. On either side of rib 36 between the first plate 34 and the second 28, there is formed a channel 38. Each channel 38 is designed to accept and engage one side edge 13 of slot 12. The second plate 28 will typically be wider than slot 12.

Plates 34 and 28 are of a smaller height than plate 34 and pad 28 of the embodiment shown in FIG. 4. In addition, second plate 28 is not configured to be a finger pad or finger receiving surface. In this alternative embodiment, member 22 including disk 24 is moved upward by placing the user's finger in slot 12 and under the disk. To move member 22 downward in holder 10, the user's finger can either be placed in slot 12 and pressed downward on the top of lip 25 or on the outer wall of the lip.

Figure 6:
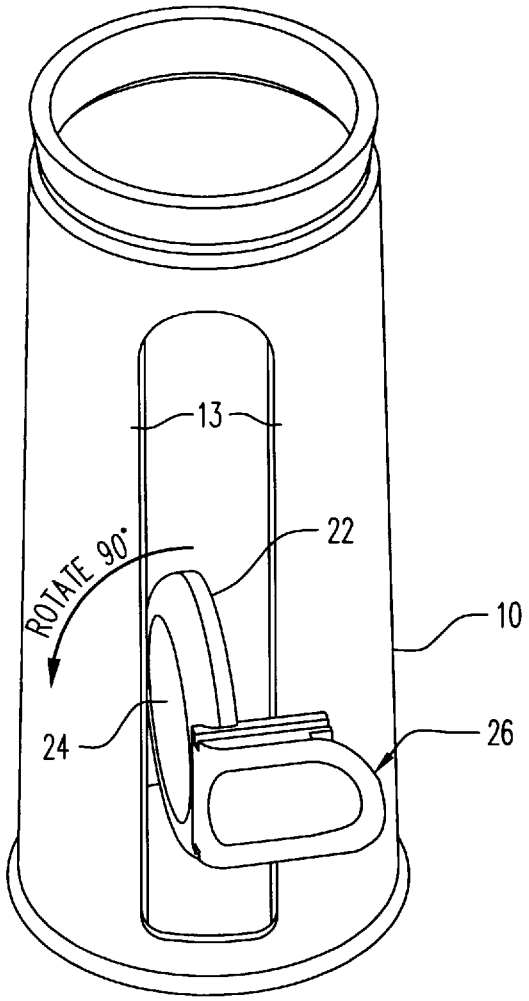
FIG. 6 is a schematic view of the plunger member of FIG. 4 being assembled into the preferred holder of FIG. 3.

As shown in FIG. 6, member 22 can be removed from the holder 10 by twisting and rotating unit 26 approximately ninety degrees until disk 24 is vertically aligned with slot 12. By the twisting and rotation, channels 38 disengage from edges 13. Then, member 22 can be withdrawn through slot 12. To reinsert unit 26, the user inserts the vertically positioned disk 24 in through slot 12 until the unit is aligned with the slot. The unit 26 is then rotated approximately ninety degrees and snapped into alignment with the edges 13 of slot 12.

Figure 7:
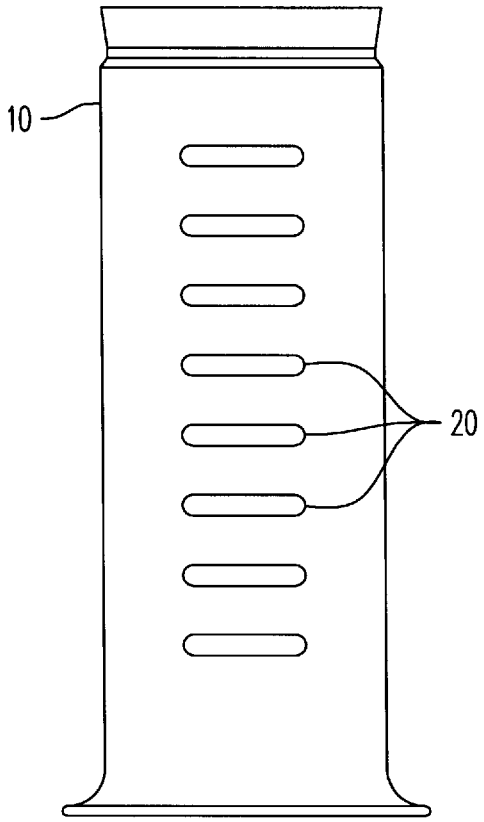
FIG. 7 is a second side view, opposite to the first side view, of the holder of the holder assembly of FIG. 1.

As shown in FIG. 7, on the side of holder 10 opposite slot 12, there is, preferably, a series of spaced ridges 20. The ridges 20 form a gripping surface to allow the user to readily grip the holder 10 in one hand. Preferably, the ridges 20 are horizontally positioned, and are of small extent. The space between each adjacent pair of ridges 20 is adapted to receive a user's fingers. The ridges 20 can also be raised a sufficient amount so as to provide a deeper space between each adjacent pair of ridges. Alternatively, ridges 20 need not be ridges, but can be embossments, slots or the like.

Figure 8:
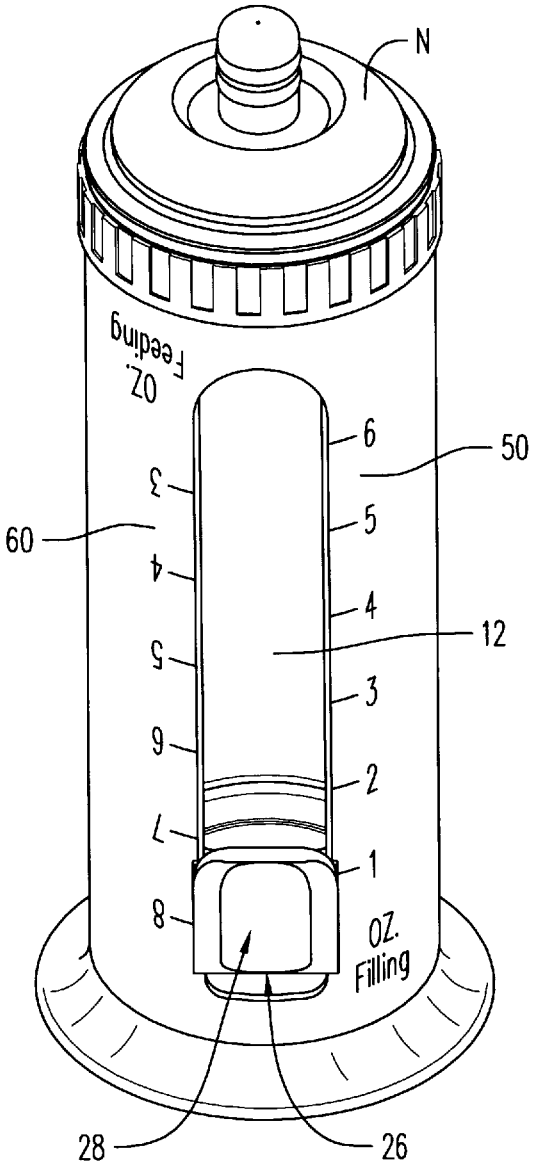
FIG. 8 is a plan view of the holder assembly of FIG. 1, with a nipple, retaining ring and liner, and with dual marking feature.

Referring to FIG. 8, there is, preferably, two rows of markings along slot 12. The first row 50 preferably positioned on an edge of slot 12 is numbered in ascending order from the bottom to the top of holder 10 and may be in consecutive number order. In a preferred embodiment, it is numbered 1 through 6 in order to determine the number of ounces of liquid in a liner in holder 10. The second row 60 is also positioned on an edge of slot 12. The second row 60 is also in ascending order but from the top to the bottom of holder 10, and may be in consecutive number order. In the preferred embodiment, the second row is numbered 3 through 8. The volume or ounce marking starts with number 3 since there is not enough surface space remaining on the holder 10 when the member 22 is in the full upright position to show the lesser, namely 1 and 2, ounce markings. The markings or numbers in the second row 60 are upside down with respect to the markings in the first row 50. This allows the readings to be read easily when the holder 10 is held in the feeding position.

In the preferred embodiment, first row 50 is on one edge 13 of slot 12, and second row 60 is on the other edge of the slot, as shown in FIG. 8.

The first row 50 is used for filling liquid into holder 10. In particular, when holder 10 is positioned on a flat surface, such as a counter or table top, liquid is poured into the liner in the holder and a user can easily determine how much liquid is placed therein. Accordingly, this removes the need for pre-measuring the amount of liquid that will be placed into the liner.

The second row 60 is used during feeding. You can determine from the second row 60 the amount of liquid remaining in the liner while the baby is feeding. The bottom edge of pad 28 when firmly pushed up in contact with the liner and aligned with the feeding volume markings 60 and after all air is removed from the liner, allows the user to determine the level of fluid remaining in the liner.

Figure 9:
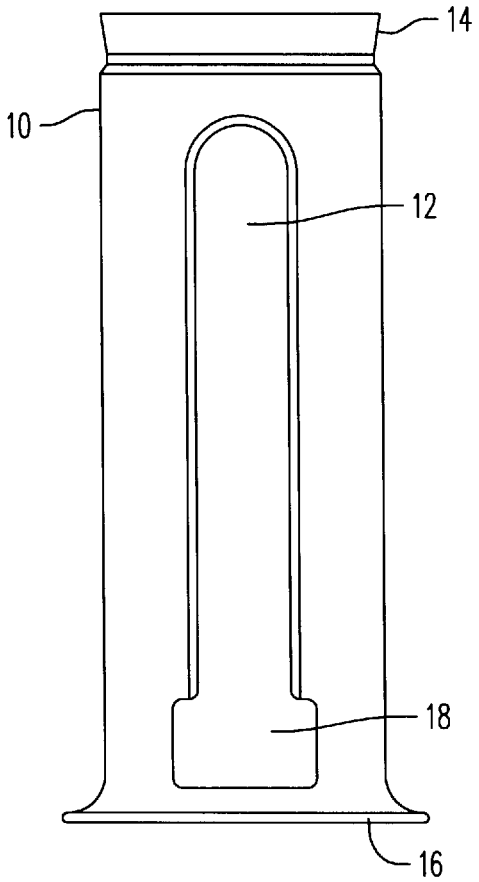
FIG. 9 is a side view of an alternative holder assembly of the present invention.

FIG. 9 is an alternative embodiment in which the slot 12 preferably has a lower end 18 that is widened and substantially rectangular in shape. The lower end 18 provides for the insertion and removal of member 22 without twisting or rotating of disk 24. Accordingly, the width of slot 12 in this embodiment may be less than in the FIGS. 2 and 3 embodiment. In this embodiment, the user can disassemble member 22 from holder 10 by pushing down on unit 26 and lowering member 22 into the lower end 18 of slot 12. By pushing unit 26 through lower end 18 of slot 12, the unit will then disengage from the holder 10, and is removed from the holder by pressing disk 24 down and out the open bottom of holder 10. The unit 26 is reinserted by reversing this process.

In this embodiment, unit 26 may be smaller than the lower end 18 so that member 22 can be inserted therein and removed therefrom with ease.

In use in either embodiment, a disposable liner is inserted into holder 10. Liquid is poured into the liner, and a nipple N and nipple retaining ring 45 is affixed to holder 10, thus securing the liner in the holder. The member 22 is moved up firmly against the liner maintaining the pressure on the liner until all the air is purged through the nipple aperture and a small amount of liquid is dispensed. The holder assembly 1 is inverted into feeding position, and fluid is withdrawn by the baby. The pad 28 is pressed with the thumb to overcome the frictional engagement of channels 38 and edges 13 and slide member 22 up within the holder 10. The disk 24 maintains slight compression on the fluid-filled liner and thereby minimizes any air returning to the liner.

The invention having been thus described with particular reference to the preferred forms thereof, it will be obvious that various changes and modifications may be made therein without departing from the spirit and scope of the invention as defined in the appended claims.

What we claim is:

1. A holder assembly for a disposable liner that expels air from the liner, said holder assembly comprising:

a holder having a single axial slot, said slot having an inner surface and an outer surface; and means, adapted to be positioned in said holder, for movement in said holder to urge air from the liner, said movement means being adapted to engage said inner and outer surfaces of said single axial slot without engaging said holder in an area opposite said single axial slot for positioning said movement means in said holder, whereby said holder can be used with one hand by the user.

2. The holder assembly of claim 1, wherein said movement means includes a disk and attachment means secured to said disk.

3. The holder assembly of claim 2, wherein said attachment means engages said inner surface and said outer surface of said slot to mount said disk slidably within said holder.

4. The holder assembly of claim 2, wherein said attachment means comprises a pad and an aligned plate portion integral with said disk.

5. The holder assembly of claim 4, wherein said pad and said plate portion are joined by a central bridge thus forming two slot-accepting channels.

6. The holder assembly of claim 4, wherein said pad is flared outward at an upper edge thereof to form a thumb-engaging surface.

7. The holder assembly of claim 2, wherein said disk includes a lip to form a cup-shaped surface on said disk.

8. The holder assembly of claim 2, wherein said disk is approximately the same size as yet there is a clearance between said outer surface of said disk and an inner circumferential dimension of said holder.

9. The holder assembly of claim 2, wherein said slot has a pair of side edges for engagement with said attachment means.

10. The holder assembly of claim 1, further comprising a longitudinal series of spaced ridges of small extent for facilitating gripping by the user of said holder.

11. The holder of claim 1, wherein said single axial slot is flared at a first end of said slot to facilitate removal of said movement means from said holder.

12. The holder of claim 1, wherein said movement means is adapted to simultaneously engage an axially elongated extent of said inner and outer surfaces of said single axial slot.

13. A holder assembly for a disposable liner that expels air from the liner, said holder assembly comprising:

a holder having a single axial slot, said slot having an inner surface and an outer surface; and, means, adapted to be positioned in said holder, for movement in said holder to urge air from the liner, said movement means engaging said inner and outer surfaces of said single axial slot for positioning in said holder; whereby said holder can be used with one hand by the user, and wherein said slot is flared at a first end of said slot to facilitate removal of said movement means.

14. The holder of claim 13, wherein said movement means engages said inner and outer surfaces of said single axial slot without engaging said holder in an area opposite said single axial slot.

15. The holder of claim 13, wherein said movement means is adapted to simultaneously engage an axially elongated extent of said inner and outer surfaces of said single axial slot.

16. A holder assembly for expelling air from a liquid-accepting liner supported within said holder assembly, comprising:

a cylindrical-type holder having a single axial slot in a portion of one side of said holder, said slot having a pair of side edges, each side edge having an inner surface and an outer surface; and means, adapted to be positioned in said holder, for movement in said holder to urge air from said liner, said movement means being adapted to engage said inner and outer surfaces of said side edges of said slot without engaging said holder in an area opposite said single axial slot for positioning said movement means in said holder, wherein said movement means can be activated by a finger of the user so that said holder assembly can be used with one hand of the user.

17. The holder assembly of claim 16, wherein said movement means includes a disk having a clearance between said disk and said holder to allow said disk to be moved axially within said holder.

18. The holder assembly of claim 17, wherein said movement means includes attachment means, and said attachment means engages said inner and outer surfaces of said side edges of said slot to mount said disk for slidable movement within said holder.

19. The holder assembly of claim 18, wherein said attachment means is secured to said disk at a single location.

20. The holder assembly of claim 18, wherein said attachment means comprises a pad and an aligned plate portion integral with said disk, and said pad and said plate portion are joined by a central bridge to form two slot-accepting channels.

21. The holder assembly of claim 20, wherein said attachment means is a single integral piece.

22. The holder assembly of claim 20, wherein said slot-accepting channels are open in a direction facing opposite to said central bridge.

23. A holder assembly for a disposable liner that expels air from the liner with one hand of a user, said holder assembly comprising:

a cylindrical-type holder having a single elongated, axial slot in at least a portion of one side of said holder, said slot having a pair of side edges, each side edge having an inner surface and an outer surface; and means, adapted to be positioned in said holder for movement in said holder, to urge air from said liner, said movement means including attachment means for engaging said pair of side edges of said slot without engaging said holder in an area opposite said single axial slot for positioning said movement means in said holder, said movement means having a disk, and said attachment means being secured to said disk at a single location, wherein said movement means can be activated by a finger of the user so that said holder assembly can be used with one hand of the user.

24. The holder assembly of claim 23, wherein said attachment means comprises a button and an aligned plate portion integral with said disk.

25. A holder assembly for a disposable liner that expels air from the liner with one hand of a user, said holder assembly comprising:

a cylindrical holder having a single elongated slot extending from a point adjacent to a top, nipple assembly-engaging edge of said holder to a lower end point adjacent an extended bottom support edge of said holder, said slot being defined by a pair of side edges, each side edge having an inner surface and an outer surface, wherein a portion of said slot is flared at said lower end point adjacent said extended bottom support edge;

a cup-shaped disk for movement against the liner; and a thumb-accepting pad assembly adapted to engage said pair of side edges of said slot, wherein said pad assembly is mounted in said slot to allow a user to move said pad assembly freely in said slot by means of one hand of the user, and wherein said flared portion of said slot and said pad assembly are adapted such that said pad assembly can be disengaged from said side edges of said slot and removed from said holder through said flared portion of said slot.

26. The holder assembly of claim 25, wherein said pad assembly further includes a pad and a substantially parallel plate portion and a disk integral with said plate portion, and wherein said pad and said plate portion are joined by a central bridge thus forming two slot side edge-accepting channels.

27. The holder assembly of claim 26, wherein said slot side edge-channels open in a direction facing opposite to said central bridge.

28. The holder assembly of claim 26, wherein said pad assembly is a single integral piece.

29. A holder for a disposable liner and combined marking system comprising:

a holder having at least one axial slot, said slot having an inner surface and an outer surface;

means, adapted to be positioned in said holder, for movement in said holder to urge air from the liner, said movement means engaging said inner and outer surfaces of said at least one axial slot without engaging said holder in an area opposite said at least one axial slot for positioning in said holder;

a first row of markings being numbered in ascending order from the bottom to the top of said holder for determining the volume of liquid entered into the liner; and a second row of markings being numbered in ascending order from the top to the bottom of said holder for determining the volume of liquid remaining in the liner as the baby is feeding, wherein the second row of markings is printed upside down with respect to the first row of markings.

30. The marking system of claim 29, wherein said first row of markings is positioned at a first edge of an axial slot of said holder, wherein said second row of markings positioned at a second edge of the axial slot.

31. The marking system of claim 29, wherein said first row of markings is numbered in consecutive order.

32. The marking system of claim 31, wherein said second row of markings is numbered in consecutive order.

33. A holder assembly for a disposable liner that expels air from the liner, said holder assembly comprising:

a holder having a single axial slot, said slot having an inner surface, an outer surface and a lower end that is widened; and means, adapted to be positioned in said holder, for movement in said holder to urge air from the liner, said movement means being adapted to engage said inner and outer surfaces of said single axial slot for positioning said movement means in said holder, whereby said holder can be used with one hand by the user, and wherein said widened lower end of said slot is adapted to allow said movement means to be removed from said slot and from said holder.

34. A holder assembly for a disposable liner that expels air from the liner, said holder assembly comprising:

a holder having a single axial slot, said slot having an inner surface and an outer surface; and means, adapted to be positioned in said holder, for movement in said holder to urge air from the liner, said movement means having a height dimension and being adapted to simultaneously engage said inner and outer surfaces of said single axial slot when said movement means is positioned, for positioning said movement means in said holder, whereby said holder can be used with one hand by the user, and wherein said single axial slot is axially longer than said height dimension of said movement means.

35. A holder assembly for a disposable liner that expels air from the liner, said holder assembly comprising:

a holder having a single elongated axial slot, said slot having an axially smooth inner surface and having an outer surface; and means, adapted to be positioned in said holder, for movement in said holder to urge air from the liner, said movement means having a height dimension that is less than the length of said axial slot, and said movement means being adapted to engage said inner and outer surfaces of said single axial slot for positioning said movement means in said holder, whereby said holder can be used with one hand by the user.

36. A holder assembly for expelling air from a liquid-accepting liner supported within said holder assembly, comprising:

a cylindrical-type holder having a single axial slot in a portion of one side of said holder, said slot having a pair of side edges, each side edge having an inner surface and an outer surface; and means, adapted to be positioned in said holder, for movement in said holder to urge air from said liner, said movement means being adapted to engage said inner and outer surfaces of said side edges of said slot without engaging said holder in an area opposite said single axial slot for positioning said movement means in said holder, wherein said movement means can be activated by a finger of the user so that said holder assembly can be used with one hand of the user, and wherein said slot is flared at a first end of said slot to facilitate removal of said movement means.

37. A holder assembly for a disposable liner that expels air from the liner with one hand of a user, said holder assembly comprising:

a cylindrical-type holder having a single elongated, axial slot in at least a portion of one side of said holder, said slot having a pair of side edges; and means, adapted to be positioned in said holder for movement in said holder, to urge air from said liner, said movement means including attachment means for engaging said pair of side edges of said slot for positioning said movement means in said holder, said movement means having a disk, and said attachment means being secured to said disk at a single location, wherein said movement means can be activated by a finger of the user so that said holder assembly can be used with one hand of the user, and wherein said slot is flared at a first end of said slot to facilitate removal of said movement means from said holder.

38. The holder assembly of claim 37, wherein said attachment means comprises a pad and an aligned plate portion integral with said disk, and said pad and said plate portion are joined by a central bridge to form two slot side edge-accepting channels that are open in a direction facing opposite to said central bridge.

39. A holder assembly for a disposable liner that expels air from the liner with one hand of a user, said holder assembly comprising:

a cylindrical-type holder having a bottom edge, and a single elongated, axial slot in at least a portion of one side but terminating before said bottom edge of said holder, said slot having a pair of side edges, each side edge having an axially smooth inner surface and having an outer surface; and means, adapted to be positioned in said holder for movement in said holder, to urge air from said liner, said movement means being a single unitary piece and having a height dimension that is less than the length of said axial slot, said movement means including attachment means for engaging said pair of side edges of said slot for positioning said movement means in said holder, said movement means having a disk, and said attachment means being secured to said disk at a single location, wherein said movement means can be activated by a finger of the user so that said holder assembly can be used with one hand of the user.

40. A holder assembly for a disposable liner that expels air from the liner with one hand of a user, said holder assembly comprising:

a holder having body wall, said body wall having a top end, a bottom end and a single elongated axial slot, said slot having a pair of side edges, an upper portion and a widened lower end adjacent said bottom end, said holder also having means, adapted to be positioned in said holder for movement in said holder, to urge air from said liner, said movement means including attachment means for engaging said pair of side edges of said slot for positioning said movement means on said slot of said holder, wherein said movement means can be activated by a finger of the user so that said holder assembly can be used with one hand of the user and moved along said slot, and wherein said slot and said movement means are dimensioned such that said movement means can be moved to said widened lower end of said slot where said movement means can pass through and be removed from said holder.

41. The holder assembly of claim 40, wherein said movement means cannot be disengaged from said side edges of or pass through said upper portion of said slot, but can at said widened lower end of said slot.

42. A holder assembly for a disposable liner that expels air from the liner with one hand of a user, said holder assembly comprising:

a holder having a top, a bottom and a single elongated axial slot in at least a portion of one side of said holder, said slot having a pair of side edges and a first end adjacent said bottom, said holder having means, adapted to be positioned in said holder for movement in said holder, to urge air from said liner, said movement means including attachment means for engaging said pair of side edges of said slot for positioning said movement means in said holder, wherein said movement means can used with one hand of the user and moved along said slot, and wherein said slot and said movement means are dimensioned such that said movement means cannot pass through said slot above said first end, and wherein said slot has at said first end a flared portion at which said movement means can be disengaged from said side edges and can pass through said flared portion to remove said movement means from said holder.

43. A holder assembly for a disposable liner that expels air from the liner, said holder assembly comprising:

a holder having a single axial slot, said slot having an inner surface, an outer surface, a flared lower end, and an upper portion above said flared lower end; and means, adapted to be positioned in said holder, for movement in said holder to urge air from the liner, said movement means being adapted to engage said inner and outer surfaces of said single axial slot for securing said movement means in said holder, whereby said holder can be used with one hand by the user, and wherein said movement means and said slot are adapted such that said movement means can be disengaged from said inner and outer surfaces of said slot and removed from said holder through said flared lower end.

* * * * *